US010802430B2

(12) United States Patent
Toratani et al.

(10) Patent No.: US 10,802,430 B2
(45) Date of Patent: Oct. 13, 2020

(54) IMAGE HEATING APPARATUS HAVING A BELT AND A REGULATING PORTION TO REGULATE MOVEMENT OF THE BELT IN A SHEET WIDTH DIRECTION

(71) Applicant: CANON KABUSHIKI KAISHA, Tokyo (JP)

(72) Inventors: Yasuharu Toratani, Abiko (JP); Toru Katsumi, Toride (JP); Nobuaki Hara, Abiko (JP); Kengo Koyama, Nagareyama (JP); Ayano Ogata, Kitasouma-gun (JP); Masanobu Tanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/435,871

(22) Filed: Jun. 10, 2019

(65) Prior Publication Data

US 2019/0391513 A1 Dec. 26, 2019

(30) Foreign Application Priority Data

Jun. 22, 2018 (JP) ..... 2018-119322

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2053
USPC ..... 399/329
See application file for complete search history.

(56) References Cited

U.S. PATENT DOCUMENTS

| | | | | |
|---|---|---|---|---|
| 7,283,780 | B2 | 10/2007 | Uchida et al. | |
| RE45,015 | E | 7/2014 | Uchida et al. | |
| 2008/0292374 | A1* | 11/2008 | Hiraoka | G03G 15/206 399/328 |
| 2012/0308279 | A1* | 12/2012 | Tanaka | G03G 15/2053 399/329 |
| 2013/0272762 | A1* | 10/2013 | Uekawa | G03G 15/2064 399/329 |

FOREIGN PATENT DOCUMENTS

| | | | |
|---|---|---|---|
| JP | 2006-293225 | A | 10/2006 |
| JP | 2007-025473 | A | 2/2007 |
| JP | 2012-008377 | A | 1/2012 |
| JP | 2016-148816 | A | 8/2016 |

* cited by examiner

*Primary Examiner* — Quana Grainger
(74) *Attorney, Agent, or Firm* — Venable LLP

(57) ABSTRACT

An image heating apparatus includes a first rotary member, a second rotary member a retaining portion, and a regulating portion. An end portion of the first rotary member abuts against the regulating portion and the regulating portion regulates movement of the first rotary member to the sheet width direction. The regulating portion comprises a curved surface shape having a radius of curvature of 10 mm or greater and 500 mm or smaller and protruding toward the first rotary member. An apex portion of the curved surface shape is, when viewed in the sheet width direction, positioned in an area outside of the retaining portion and on a side of the first rotary member from a tangent of the first rotary member at the nip portion. The apex portion is positioned in an area upstream in the sheet conveyance direction of a straight line that is orthogonal to the tangent.

7 Claims, 10 Drawing Sheets

IMAGE HEATING APPARATUS HAVING A BELT AND A REGULATING PORTION TO REGULATE MOVEMENT OF THE BELT IN A SHEET WIDTH DIRECTION

BACKGROUND OF THE INVENTION

Field of the Invention

The present invention relates to an image heating apparatus applied to an image forming apparatus that forms an image on a recording material using an electrophotographic system or an electrostatic recording system.

Description of the Related Art

Hitherto, an image forming apparatus adopting an electrophotographic system is applied widely in copying machines, printers, plotters, facsimiles and multifunction machines having a plurality of such functions. The electrophotographic system mainly includes exposing, developing, transferring and fixing steps, wherein during the fixing step, a toner image transferred onto a sheet is fixed by a fixing unit. A mainstream fixing unit uses a fixing belt with a support member provided at an end portion as a heating member and a roller as a pressing member, wherein the pressing roller is driven to rotationally drive the fixing unit. The fixing belt being used generally adopts a thin heat-resistant resin and the like as a base layer, which has a smaller thermal capacity compared to using a heating roller as a heating member. Therefore, if a fixing belt is used as the heating member, warmup of the unit can be realized in a shorter time compared to a case where the heating roller is used, and productivity can be improved. Since the unit has a driving unit dedicated to driving only the pressure roller, the driving unit can be realized with a minimum configuration, and costs can be cut down.

In this type of fixing unit, further thinning of the fixing belt is required to shorten the warmup time. The warmup time of the fixing belt is determined by thermal capacity of the whole fixing belt. In order to reduce the thermal capacity of the fixing belt, it is necessary to reduce either volume of the belt or specific heat thereof. Generally, it is difficult to reduce specific heat while maintaining mechanical property of the heat-resistant resin. Therefore, it is necessary to reduce the volume of the fixing belt, and in order to do so, thinning of the fixing belt is necessary.

Meanwhile, in a configuration where the end portion of the fixing belt is regulated by a support member, meandering of the fixing belt may cause the end portion of the fixing belt to abut against the support member and cause deviating force to be applied to the end portion of the fixing belt. In this state, the deviating force causes stress to occur at the end portion of the fixing belt. If the thickness of the fixing belt is simply thinned, compared to the fixing belt having a greater thickness, the stress generated at the end portion of the fixing belt tends to be increased even if the same deviating force is applied. If the increased stress exceeds an allowable stress of the fixing belt, cracks or abrasion may be generated at the end portion of the fixing belt, possibly shortening lifetime of the fixing belt. Therefore, it was difficult to simply reduce the thickness of the fixing belt in order to reduce the volume of the fixing belt.

Therefore, in order to reduce the stress that is generated at the end portion of the fixing belt, a fixing unit having a support member that reduces the deviating force acting on the end portion of the fixing belt is proposed (Publications of Japanese Patent Application Laid-Open Publication Nos. 2007-25473 and 2016-148816). According to the fixing unit disclosed in Japanese Patent Application Laid-Open Publication No. 2007-25473, a regulating surface is provided on an upstream side of a support member in a sheet conveyance direction, and an upstream side of the regulating surface in the sheet conveyance direction is projected toward the fixing belt than a downstream side of the regulating surface, by which direction of meandering of the fixing belt is either corrected or reversed in order to reduce the deviating force. According to the fixing unit disclosed in Japanese Patent Application Laid-Open Publication No. 2016-148816, elastic members are interposed on a side of the support member opposite from the fixing belt, by which meandering of the fixing belt in a state where the fixing belt abuts against the support member is corrected, and deviating force is reduced.

However, the fixing unit disclosed in publications of Japanese Patent Application Laid-Open Publication No. 2007-25473 and No. 2016-148816 is aimed at reducing the deviating force, and it is not designed to prevent the end portion of the fixing belt to be abutted locally against the support member. Therefore, even if the deviating force is reduced, the stress that occurs at the end portion of the fixing belt is increased at the end, and the increased stress may cause cracks and abrasion to be generated at the end portion of the fixing belt and shorten the lifetime of the fixing belt.

SUMMARY OF THE INVENTION

An object of the present invention is to provide an image heating apparatus that enables to suppress increase of stress that is generated at the end portion of the fixing belt and reduce the thickness of the fixing belt.

According to one aspect of the present invention, an image heating apparatus, configured to heat an image formed on a recording material, includes a first rotary member configured to be in a form of an endless belt and rotate, a second rotary member configured to be in pressure contact with the first rotary member, form a nip portion with the first rotary member, and nip a sheet at the nip portion to convey the sheet, a retaining portion configured to guide the first rotary member while retaining an end portion, in a sheet width direction orthogonal to a sheet conveyance direction at the nip portion, of the first rotary member from an inner circumference side in a rotatable manner, and a regulating portion against which the end portion of the first rotary member is configured to abut and which is configured to regulate movement of the first rotary member to the sheet width direction. The regulating portion comprises a curved surface shape having a radius of curvature of 10 mm or greater and 500 mm or smaller and protruding toward the first rotary member. An apex portion of the curved surface shape is, when viewed in the sheet width direction, positioned in an area outside of the retaining portion and on a side of the first rotary member from a tangent of the first rotary member at the nip portion. The apex portion is positioned in an area upstream in the sheet conveyance direction of a straight line that is orthogonal to the tangent when viewed in the sheet width direction.

Further features of the present invention will become apparent from the following description of exemplary embodiments with reference to the attached drawings.

DESCRIPTION OF THE EMBODIMENTS

Now, an embodiment of a fixing unit according to one example of an image heating apparatus of the present invention will be described in detail with reference to FIGS. 1 through 7C. In the present embodiment, a tandem-type full color printer is described as an example of an image forming apparatus 1 equipped with a fixing unit 46. However, the present invention is not limited to being applied to a tandem type image forming apparatus 1, and it can be applied to other types of image forming apparatuses or to a monochrome or mono color printer instead of the full color printer. Further, the present invention can be implemented in printers, various types of printing machines, copying machines, facsimiles, multifunction devices and so on for various uses.

Figure 1:
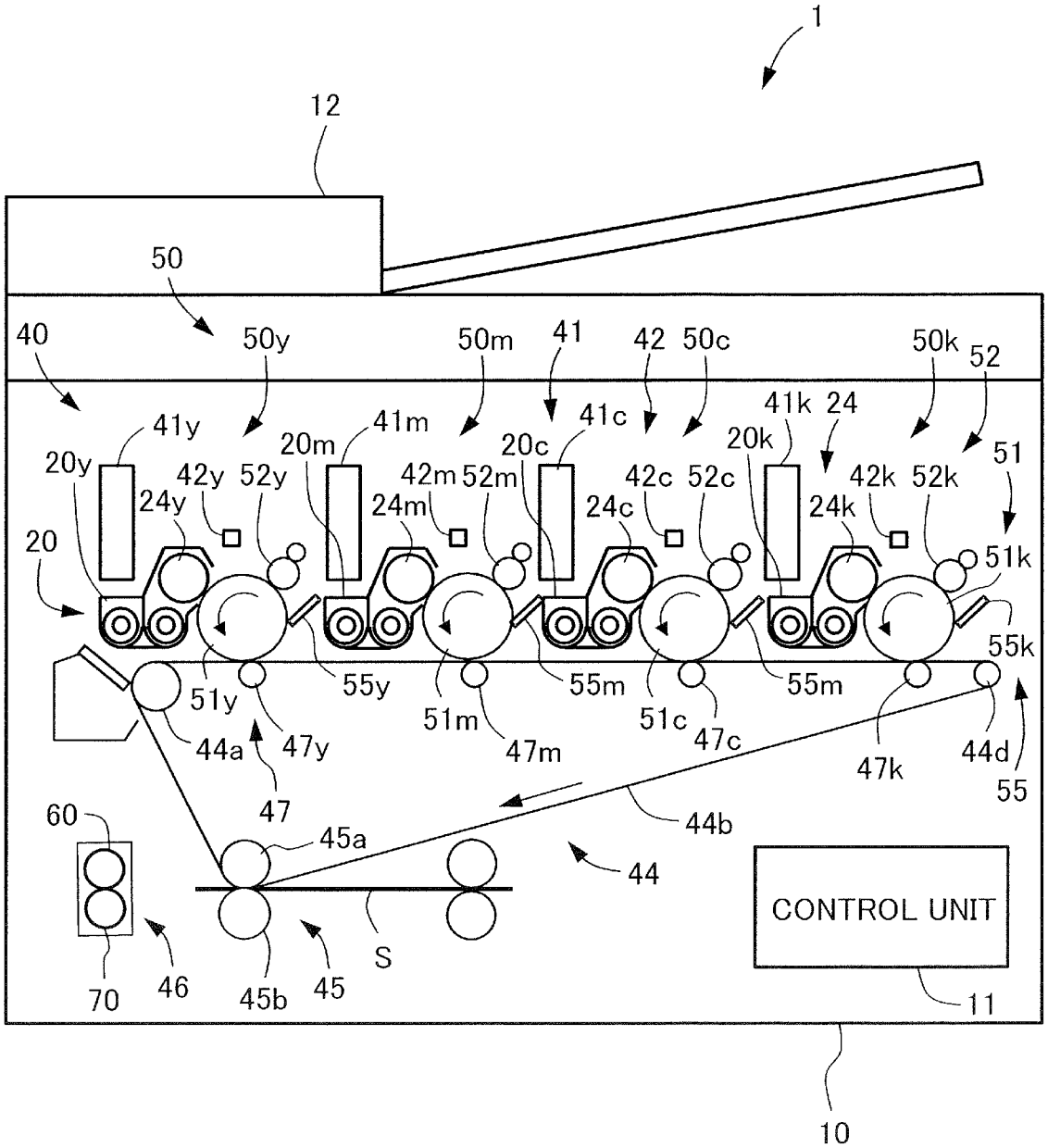
FIG. 1 is a cross-sectional view illustrating a general configuration of an image forming apparatus according to a present embodiment.

As illustrated in FIG. 1, the image forming apparatus 1 includes an apparatus body 10, a sheet feeding portion not shown, an image forming unit 40, a control unit 11, and an operating unit not shown. The image forming apparatus 1 is capable of forming a four-color full color image on a recording material according to an image signal from a document reading apparatus 12, a host device such as a personal computer, or an external device such as a digital camera or a smartphone. A sheet S serving as a recording material is a material on which a toner image is formed, an actual example of which includes normal paper, synthetic resin sheet used as substitute for normal paper, thick paper, OHP sheet and so on.

Image Forming Unit

The image forming unit 40 is capable of forming an image on the sheet S fed from the sheet feeding portion based on image information. The image forming unit 40 is equipped with image forming units 50*y*, 50*m*, 50*c* and 50*k*, toner bottles 41*y*, 41*m*, 41*c* and 41*k*, exposing units 42*y*, 42*m*, 42*c* and 42*k*, an intermediate transfer unit 44, a secondary transfer portion 45, and a fixing unit 46. The image forming apparatus 1 according to the present embodiment corresponds to full color image, and image forming units 50*y*, 50*m*, 50*c* and 50*k* having a similar configuration are independently provided for each of the colors of yellow (y), magenta (m), cyan (c) and black (k). In FIG. 1, color identifiers are attached to the end of reference numbers assigned to the same components, but in the present specification, the configuration may be described by showing only the reference numbers without adding color identifiers thereto.

An image forming unit 50 includes a photosensitive drum 51 that bears a toner image and moves, a charge roller 52, a developing device 20, and a cleaning blade 55. The image forming unit 50 is integrally formed as a unit as a process cartridge, configured to be detachably attached to the apparatus body 10 and forming a toner image to an intermediate transfer belt 44*b* described later.

The photosensitive drum 51 is formed rotatably and bears an electrostatic latent image used for forming image. The photosensitive drum 51 according to the present embodiment is an organic photoreceptor (OPC: organic photoconductor) having negative chargeability with an outer diameter of 30 mm, and it is driven to rotate by a motor not shown in an arrow direction by predetermined process speed (peripheral speed). The charge roller 52 adopts a rubber roller that contacts the surface of the photosensitive drum 51 and driven to rotate thereby, and the charge roller charges the surface of the photosensitive drum 51 uniformly. An exposing unit 42 is a laser scanner, and it generates laser beams based on image information of decomposed colors output from the control unit 11.

The developing device 20 includes a developing sleeve 24, and when a developing bias is applied, the electrostatic latent image formed on the photosensitive drum 51 is developed by toner. The developing device 20 stores developer supplied from a toner bottle 41 and develops the electrostatic latent image formed on the photosensitive drum 51. The developing sleeve 24 is formed of a nonmagnetic material such as aluminum or nonmagnetic stainless steel, and in the present embodiment, it is formed of aluminum A magnet roller is fixed to the inner side of the developing sleeve 24 in a nonrotatable manner with respect to a developing container. The developing sleeve 24 bears developer composed of nonmagnetic toner and magnetic carrier, and coveys the developer to a developing area opposed to the photosensitive drum 51.

The toner image developed on the photosensitive drum 51 is primarily transferred to the intermediate transfer unit 44. The cleaning blade 55 adopts a counter blade system, and it is abutted against the photosensitive drum 51 with predetermined pressing force. After primary transfer, the toner remaining on the photosensitive drum 51 without being transferred to the intermediate transfer unit 44 is removed by the cleaning blade 55 disposed in a manner abutted against the photosensitive drum 51 and prepares for the next image creating step.

The intermediate transfer unit 44 includes a plurality of rollers such as a drive roller 44*a*, a driven roller 44*d* and primary transfer rollers 47*y*, 47*m*, 47*c* and 47*k*, and the intermediate transfer belt 44*b* wound around the rollers and moves while bearing toner image. The driven roller 44*d* is a tension roller that is set to control the tension of the intermediate transfer belt 44*b* to a constant value. Force in a direction pushing the intermediate transfer belt 44*b* toward the surface side is applied to the driven roller 44*d* by urging force of an urging spring not shown. The primary transfer rollers 47*y*, 47*m*, 47*c* and 47*k* are respectively opposed to photosensitive drums 51*y*, 51*m*, 51*c* and 51*k*, abut against the intermediate transfer belt 44*b* and primarily transfer the toner image on the photosensitive drum 51 to the intermediate transfer belt 44*b*.

The intermediate transfer belt 44*b* abuts against the photosensitive drum 51 and forms a primary transfer portion with the photosensitive drum 51, and in a state where primary transfer bias is applied, the toner image formed on the photosensitive drum 51 is primarily transferred at the primary transfer portion. By applying a primary transfer bias of positive polarity from a primary transfer roller 47 to the intermediate transfer belt 44*b*, respective toner images having negative polarity on the respective photosensitive drums 51 are sequentially transferred in multiple layers to the intermediate transfer belt 44*b*.

The secondary transfer portion 45 includes a secondary transfer inner roller 45*a* and a secondary transfer outer roller 45*b*. The secondary transfer outer roller 45*b* abuts against the intermediate transfer belt 44*b*, and a secondary transfer bias having an opposite polarity as toner is applied to the nip portion between the intermediate transfer belt 44*b*. Thereby, the secondary transfer outer roller 45*b* collectively secondarily transfers the toner image borne on the intermediate transfer belt 44*b* to the sheet S fed to the nip portion.

The fixing unit 46 includes a fixing belt 60 and a pressure roller 70. By having the sheet S nipped between the fixing belt 60 and the pressure roller 70 conveyed to the sheet conveyance direction, the toner image transferred onto the sheet S is heated, pressed and fixed to the sheet S. The detailed configuration of the fixing unit 46 will be described later.

Control Unit

The control unit 11 is composed of a computer, and includes, for example, a CPU, a ROM that stores programs for controlling respective units, a RAM for storing data temporarily, and an input output circuit that enters signals from or output signals to the exterior. The CPU is a microprocessor that controls the whole image forming apparatus 1, and it is a main body of the system controller. The CPU is connected via the input output circuit to the sheet feeding portion, the image forming unit and the like, communicates signals with the respective units and controls the operations thereof. The ROM stores an image forming control sequence and the like for forming an image on the sheet S.

Image Forming Operation

Next, an image forming operation of the image forming apparatus 1 configured as above will be described. In a state where the image forming operation is started, at first, the photosensitive drum 51 rotates and the surface thereof is charged by the charge roller 52. Then, laser beam is irradiated from the exposing unit 42 to the photosensitive drum 51 based on image information, and an electrostatic latent image is formed on the surface of the photosensitive drum 51. By attaching toner to the electrostatic latent image, the image is developed, visualized as toner image and transferred onto the intermediate transfer belt 44*b*.

Meanwhile, a sheet S is fed in parallel with the toner image forming operation, and the sheet S is conveyed via a transfer path to the secondary transfer portion 45 at a matched timing with the toner image on the intermediate transfer belt 44*b*. Further, image is transferred from the intermediate transfer belt 44*b* to the sheet S, and the sheet S is conveyed to the fixing unit 46, where unfixed toner image is heated, pressed and fixed to the surface of the sheet S, and the sheet S is discharged from the apparatus body 10.

Fixing Unit

Figure 2:
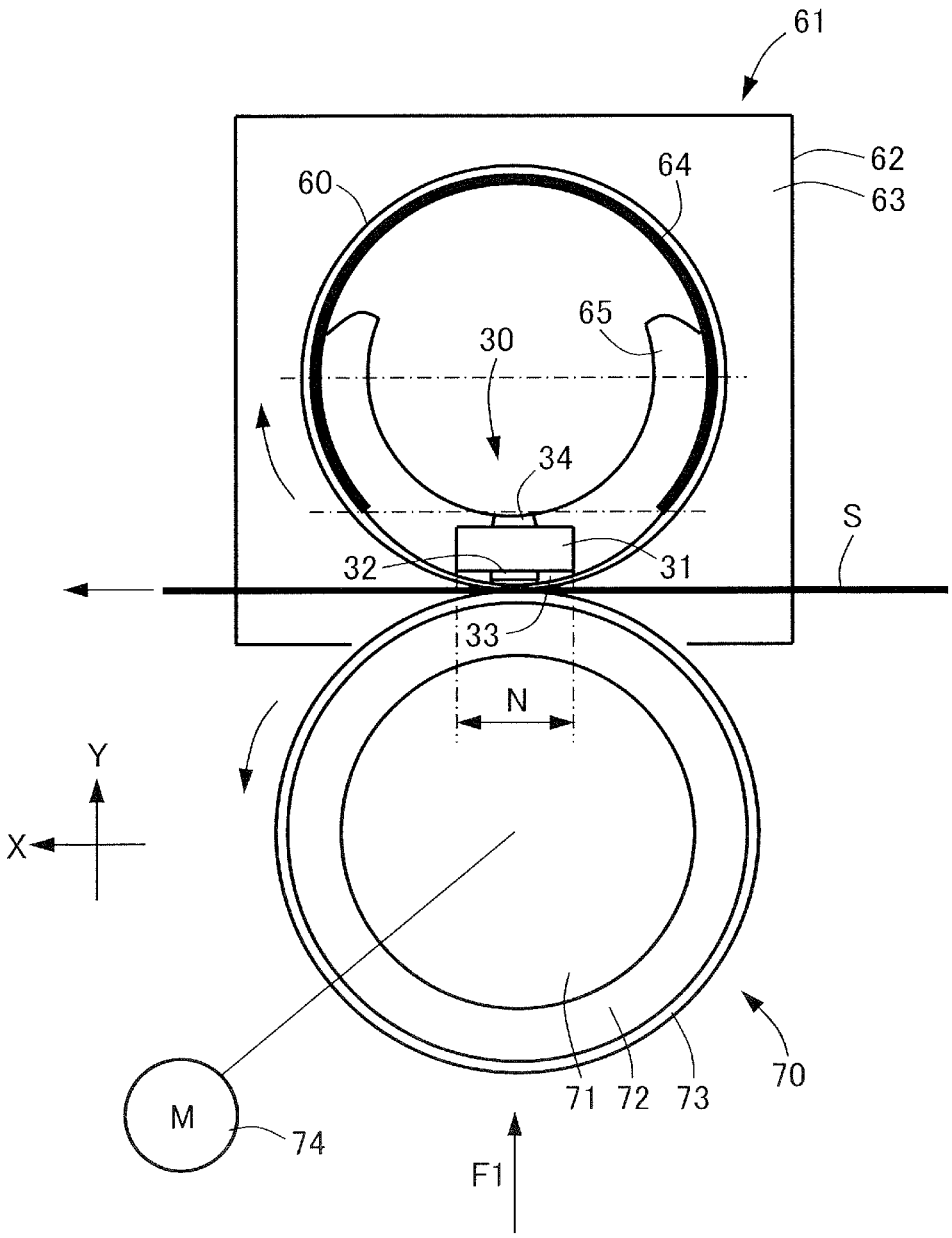
FIG. 2 is a cross-sectional view illustrating a fixing unit according to the present embodiment.
Figure 3:
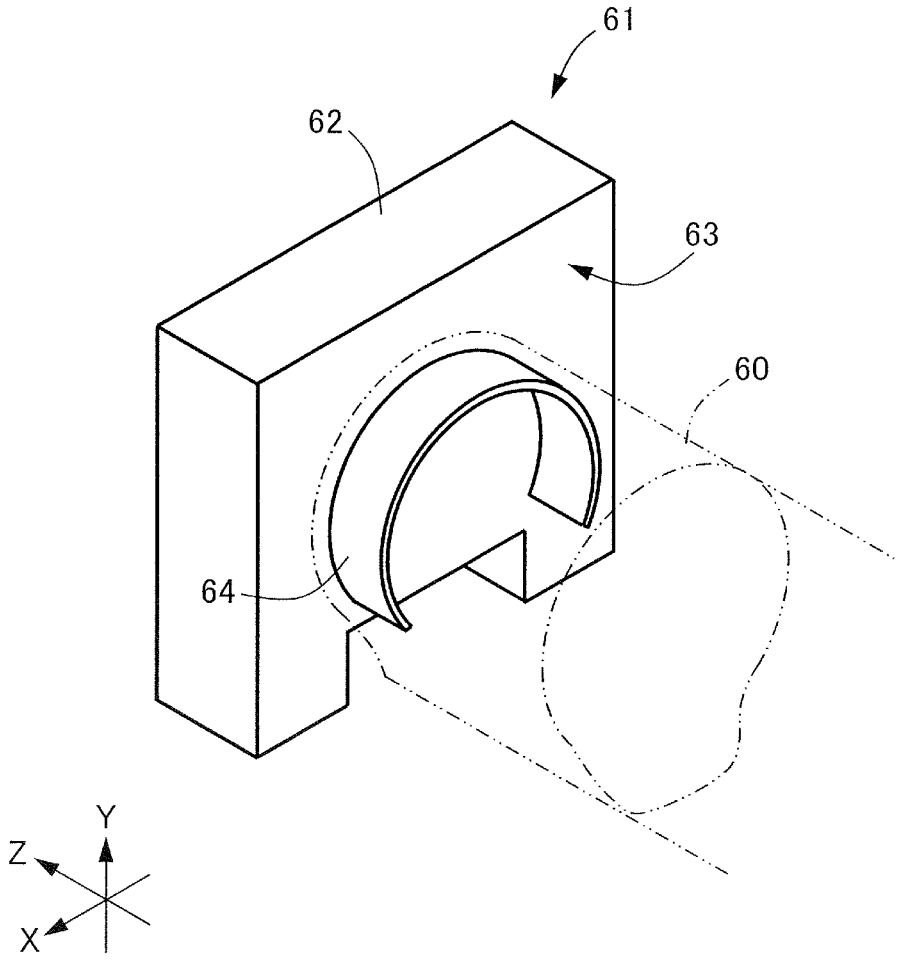
FIG. 3 is a perspective view of a support member and a fixing belt of the fixing unit according to the present embodiment.

Next, a configuration of the fixing unit 46 will be described in detail. As illustrated in FIGS. 2 and 3, the fixing unit 46 includes a fixing belt, serving as a first rotary member, 60 in a form of a rotatable endless belt, a support member 61 that supports both end portions of the fixing belt 60, a heater portion 30, a heater holder 65, and a pressure roller, serving as a second rotary member, 70. The heater portion 30 heats the fixing belt 60 from an inner circumference side. In the present embodiment, the heater portion 30 is designed to heat the fixing belt 60 from the inner circumference side, but the present invention is not limited thereto, and the heater portion 30 can be designed to heat the fixing belt 60 from the outer circumferential side. The pressure roller 70 is in pressure contact with the fixing belt 60 and forms a fixing nip portion, serving as a nip portion, N with the fixing belt 60, and the pressure roller 70 rotates the fixing belt 60 by rotating and nips the sheet S at the fixing nip portion N to convey the sheet S. In the present embodiment, a conveyance direction of the sheet S at the fixing nip portion N between the fixing belt 60 and the pressure roller 70 is referred to as a sheet conveyance direction X, and a sheet width direction orthogonal to the sheet conveyance direction X, that is, a longitudinal direction of the fixing belt 60 and the pressure roller 70 is referred to as a longitudinal direction Z. Further, a pressure applying direction from the pressure roller 70 to the fixing belt 60, which is orthogonal to the sheet conveyance direction X and the longitudinal direction Z, is referred to as a pressure direction Y.

The heater portion 30 is, for example, a heat source such as a resistance heating element, which generates heat by having power supplied from a power supply not shown and is controlled to a predetermined controlled temperature by the control unit 11. The heater portion 30 is fixed to and supported by the heater holder 65. The heater holder 65 is formed of a heat resistant material having rigidity and formed to have an approximately semicircular arc-shaped section, that is, an approximately C-shaped section, with a groove portion 65*a* (refer to FIG. 6) formed along the longitudinal direction Z on a lower surface at a center portion of the outer circumferential side. The heater portion 30 is fit to the groove portion 65*a* of the heater holder 65.

The heater portion 30 includes a heater substrate 31 formed of a ceramic thin plate arranged along the longitudinal direction Z, an electric heating element 32 serving as a resistance heating element, a surface protection layer 33, and a temperature detection element 34. The electric heating element 32 is a linear or strip-like heating element formed along the longitudinal direction Z on a surface side, that is, on a side that slides against the fixing belt 60 of the heater substrate 31. The surface protection layer 33 is a thin layer that covers the electric heating element 32. The temperature detection element 34 is, for example, a thermistor arranged to be in contact with a rear side of the heater substrate 31.

The control unit 11 rapidly heats the heater portion 30 by having power fed to the electric heating element 32, and thereafter, uses the temperature detection element 34 to control the heater portion 30 to maintain a predetermined fixing temperature, that is, target temperature. In the fixing unit 46 according to the present embodiment, a heater is used as the heat source, but the present invention is not limited thereto, and for example, a halogen heater or an IH heater can be used as the heat source.

Fixing Belt

According to the present embodiment, the fixing belt 60 is formed into a film shape having a three-layer structure composed of, from the inner side, an annular base material, a belt elastic layer, and a surface layer. However, the fixing belt 60 is not necessarily film shaped. The fixing belt 60 is an endless belt whose inner circumferential surface slides against the heater portion 30 and the heater holder 65 during state of use, and it is fit to the outer circumference of the heater holder 65 supporting the heater portion 30 with a sufficient allowance in circumferential length. Lubricant such as grease is applied to the inner circumferential surface of the fixing belt 60 to ensure slidability with the heater portion 30 and the heater holder 65. Both end portions of the fixing belt 60 in the longitudinal direction Z are supported rotatably on the support member 61 fixed to a frame not shown of the fixing unit 46. The fixing belt 60 rotates following the rotation of the pressure roller 70.

In consideration of the required heat resistance and flex resistance, the base material of the fixing belt 60 is formed of heat-resistant resin such as polyimide, polyamide imide, polyether ether ketone (PEEK) and so on. Further, in order to additionally consider thermal conductivity, metal such as stainless steel (SUS), nickel and nickel alloy having higher thermal conductivity compared to heat-resistant resin can also be used. Since the base material must have small thermal capacity while exerting high mechanical strength, the thickness of the base material should be 5 μm or greater and 100 μm or smaller, and more preferably, 20 μm or greater and 85 μm or smaller.

The belt elastic layer of the fixing belt 60 is a silicon rubber layer that covers the outer circumference of the base material. In a state where the sheet S passes through the fixing nip portion N, the belt elastic layer applies heat uniformly to the nonfixed toner in a manner enveloping the nonfixed toner on the sheet S. A high-gloss high-quality image without any uneven fixture can be acquired by the belt elastic layer functioning in the above-described manner. However, if the thickness of the belt elastic layer is too thin, sufficient elasticity of the belt elastic layer cannot be obtained, and high-quality image cannot be obtained. Meanwhile, if the thickness of the belt elastic layer is too thick, the thermal capacity of the belt elastic layer is increased, and depending on the heat, it may require a long time for the belt to reach the predetermined temperature. Therefore, the thickness of the belt elastic layer should preferably be 30 μm or greater and 500 μm or smaller, and more preferably, 100 μm or greater and 300 μm or smaller. The material of the belt elastic layer is not specifically limited, but from the viewpoint of facilitating processing, realizing processing with high dimensional accuracy and not creating reaction byproducts during heating and curing, it is preferable to use a liquid-type, addition reaction crosslinking-type silicon rubber.

If the belt elastic layer is formed of a simple silicon rubber, the thermal conductivity of the belt elastic layer will be low. If the thermal conductivity of the belt elastic layer is low, the heat generated at the heater portion 30 cannot easily be conducted to the sheet S through the fixing belt 60, so that heating may not be sufficient when fixing the toner to the sheet S and image failure such as fixing unevenness may be caused. Therefore, in order to improve the thermal conductivity of the belt elastic layer, a filler having high thermal conductivity, such as a granular high thermal conductivity filler, is mixed and dispersed in the belt elastic layer. Examples of the granular high thermal conductivity filler include silicon carbide (SiC), zinc oxide (ZnO), alumina ($Al_2O_3$), aluminum nitride (AlN), magnesium oxide (MgO), carbon and so on. Further, depending on the object, a needle-like high thermal conductivity filler and the like can be used instead of the granular high thermal conductivity filler. That is, the shape of the high thermal conductivity filler is not limited to granular and needle-like shapes, and other shapes such as crushed, plate-like or whisker-like shapes can be used in the belt elastic layer. Further, only one type of filler can be used, or a mixture of two or more fillers can be used. By mixing a high thermal conductivity filler into the belt elastic layer, the belt elastic layer is also given conductivity.

The surface layer is a fluororesin layer that covers the outer circumference of the belt elastic layer. The surface layer is provided to prevent toner from being easily attached to the fixing belt 60. It is preferable to apply fluororesin such as tetrafluoroethylene-perfluoroalkyl vinyl ether copolymer resin (PFA), tetrafluoroethylene resin (PTFE), tetrafluoroethylene-hexafluoropropylene copolymer resin (FEP) and so on as the surface layer. The thickness of the surface layer should preferably be 1 μm or greater and 50 μm or smaller, and more preferably, 8 μm or greater and 25 μm or smaller. The surface layer should be formed on the outer circumference of the belt elastic layer by covering the layer with fluororesin tube or applying a coating material formed of fluororesin. In the fixing unit of the present embodiment, an example has been illustrated where the fixing belt 60 includes an elastic layer, but the present invention is not limited thereto. For example, the fixing belt can be formed of a belt base layer and a belt surface layer, without an elastic layer.

Pressure Roller

The pressure roller 70 includes, from an inner side, a cylindrical base 71, an elastic layer 72, and a release layer 73. Both end portions of the base 71 in the longitudinal direction Z are supported rotatably on a fixed portion such as a frame not shown of the fixing unit 46. The pressure roller 70 is arranged at a position opposed to the heater portion 30 supported on the heater holder 65 with the fixing belt 60 interposed therebetween. By having a predetermined pressing force F1 applied to the pressure roller 70 and the fixing belt 60 from a pressurizing mechanism not shown, the pressure roller 70 and the fixing belt 60 are in pressure contact with each other, and the elastic layer 72 and the belt elastic layer are elastically deformed. Thereby, a fixing nip portion N having a predetermined width in the sheet conveyance direction X is formed between the pressure roller 70 and the fixing belt 60. Detailed description of the pressurizing mechanism will be omitted, since an existing or new appropriate mechanism can be adopted as the pressurizing mechanism.

The pressure roller 70 is driven to rotate during use, for example, by a drive source such as a drive motor 74. In a state where the pressure roller 70 is driven to rotate by the drive motor 74, the sheet S is nipped and conveyed by the fixing nip portion N between the pressure roller 70 and the fixing belt 60 being driven to rotate thereby. Further, the fixing belt 60 is heated until the surface reaches a predetermined temperature (for example, 180° C.) by the heater portion 30. In this state, if the sheet S on which unfixed toner image is formed by toner is conveyed to the fixing nip portion N, the unfixed toner on the sheet S is heated and pressed. Thereby, unfixed toner is melted and mixed, so that by cooling the same, the toner image is fixed to the sheet S as fixed image.

The base 71 of the pressure roller 70 is composed of a shaft core or a core metal formed of stainless steel, phosphor bronze, aluminum and the like including steel material such as SUM material (sulfur and sulfur composite free-cutting steel material) plated with nickel and chrome. The outer diameter of the base 71 can be set to 4 mm to 80 mm, for example.

The elastic layer 72 of the pressure roller 70 is a silicon rubber layer covering the outer circumference of the base 71. A needle-like high thermal conductivity filler or a granular high thermal conductivity filler is mixed and dispersed in the elastic layer 72. Silicon carbide (SiC), zinc oxide (ZnO), alumina ($Al_2O_3$), aluminum nitride (AlN), magnesium oxide (MgO), carbon and so on are used as the granular high thermal conductivity filler, similar to the belt elastic layer of the fixing belt 60. The granular high thermal conductivity filler is mixed in order to improve the thermal conductivity of the elastic layer, and it is not necessarily added in some cases.

The present embodiment has been described of a case where the elastic layer 72 is a monolayer, but the present invention is not limited thereto, and for example, the elastic layer can be a multilayer. If the elastic layer is a multilayer, it is possible to provide a primer layer or an adhesive layer between the elastic layers or between the elastic layer 72 and the release layer 73 for purposes such as adhesion or power conduction.

The release layer 73 of the pressure roller 70 is formed, for example, of a fluororesin layer, and it is provided to prevent toner from attaching easily to the pressure roller 70. The release layer 73 is formed by covering the outer circumference of the elastic layer 72 with copolymer (PFA) tube, for example. As another example, the release layer 73 may be formed by coating a coating material formed of fluoresin such as PFA, polytetrafluoroethylene (PTFE) or tetrafluoroethylene-hexafluoropropylene copolymer (FEP) and the like to the outer circumference of the elastic layer 72. The thickness of the release layer 73 is not specifically limited, but it should preferably be around 15 μm or greater and 80 μm or smaller.

The present embodiment has been described of a case where the pressure roller 70 is applied as a member for forming the fixing nip portion N between the fixing belt 60, but the present invention is not limited thereto. For example, a thin heat-resistant resin formed of polyimide, polyamide imide, polyether ether ketone (PEEK) and the like or an endless pressure-applying belt formed of thin metal such as stainless steel (SUS) or nickel (Ni) and the like can be applied as the member for forming the fixing nip portion N.

Support Member

The support member 61 is provided at both end portions of the fixing belt 60 in the longitudinal direction Z. The support member 61 includes a plate-like base 62 having a thickness in the longitudinal direction Z, a regulating surface, serving as a regulating portion, 63 formed on a side surface of the base 62 facing the fixing belt 60, and a retaining portion 64 provided to protrude from the base 62 toward the fixing belt 60 side, which are formed integrally. The support member 61 supports the fixing belt 60 by inserting the retaining portion 64 to an inner circumferential portion of the fixing belt 60 at both end portions of the fixing belt 60. The support members 61 provided at either ends of the fixing belt 60 are plane-symmetric with respect to the regulating surface 63 and the retaining portion 64. In the accompanied drawings, only one support member 61 of the pair of support members 61 is illustrated.

The regulating surface 63 abuts against the end portion of the fixing belt 60 in the longitudinal direction Z, and regulates movement of the fixing belt 60 in the longitudinal direction Z. The retaining portion 64 retains the end portion of the fixing belt 60 with respect to the longitudinal direction Z rotatably from the inner circumference side and guides the fixing belt 60. The retaining portion 64 is formed to have a circular arc section with the upstream side in the pressure direction Y opened and extending upstream in the pressure direction Y from the center line of the fixing belt 60, that is, an approximately C-shaped section. It is preferable that the center axes of a pair of retaining portions 64 facing each other coaxially so that excessive stress is not caused in the fixing belt 60. The retaining portion 64 functions to stabilize rotational track of the fixing belt 60 while the fixing belt 60 is driven to rotate by the rotation of the pressure roller 70, in a state where the retaining portion 64 abuts against the inner circumferential surface of the fixing belt 60. Since the retaining portion 64 has an upstream side in the pressure direction Y opened, the fixing belt 60 cannot be guided by the opening area, but in the opening area, an outer circumferential surface 65*b* (refer to FIG. 6) of the heater holder 65 guides the fixing belt 60. That is, the heater holder 65 functions as a retaining portion that guides the fixing belt 60 while rotatably supporting the end portion of the fixing belt 60 with respect to the longitudinal direction Z from the inner circumference side.

Engineering plastic such as LCP/PET/PPS/PEEK resin and the like are preferably applied as the material of the support member 61, and in the present embodiment, engineering plastic using LCP as main material is applied. By applying plastic resin as material of the support member 61, freedom of shape of the support member 61 can be enhanced. According further to the present embodiment, an example has been described where the support member 61 is formed integrally, but the present invention is not limited thereto, and for example, the base 62 and the retaining portion 64 can be separate members formed of same or different materials.

Principle of Generation of Deviating Force

Figure 4:
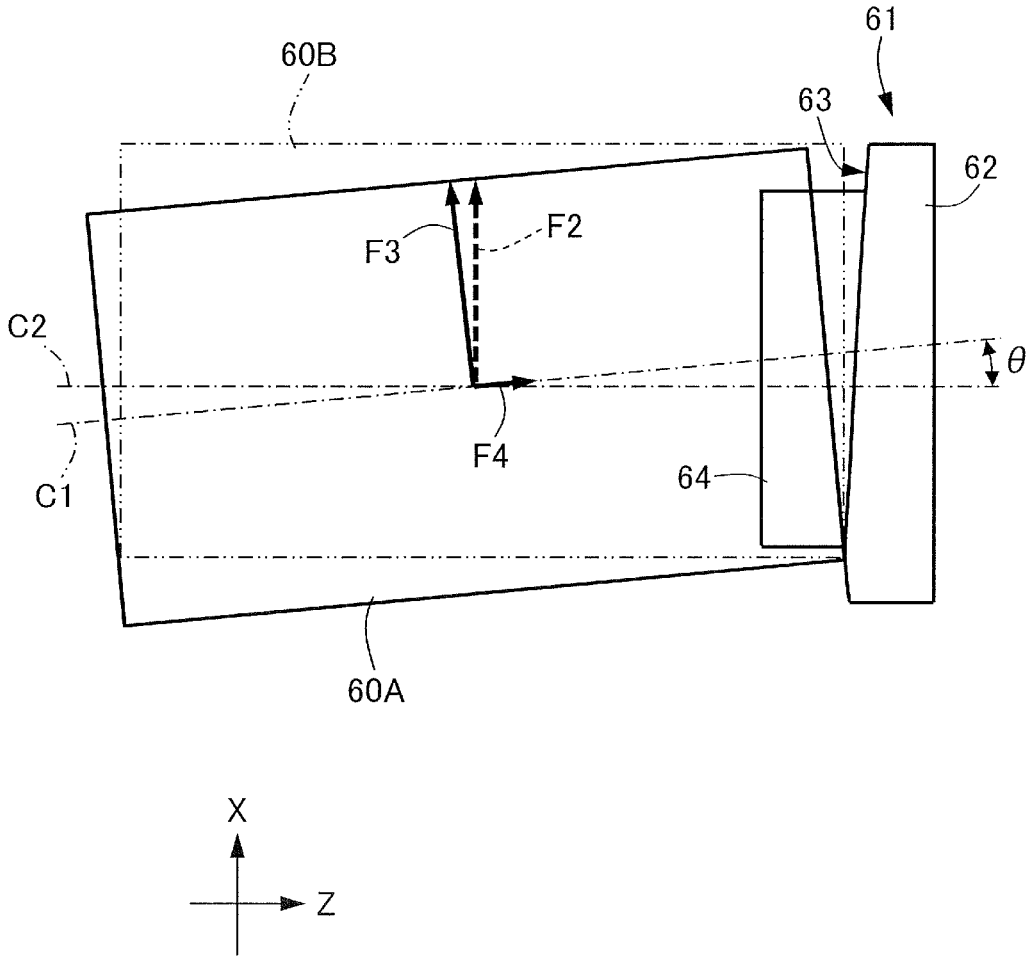
FIG. 4 is a plan view of the support member and the fixing belt of the fixing unit according to the present embodiment.

Principle of generation of deviating force at the end portion of the fixing belt 60 while driving the pressure roller 70 will be described in detail. As illustrated in FIG. 4, the fixing belt 60A at an initial position receives force from a pressurizing mechanism not shown and forms a fixing nip portion N (refer to FIG. 2) with the pressure roller 70. In this state, a center line C1 of the fixing belt 60A at the initial position is inclined with respect to a center line C2 of the pressure roller 70 based on positional relationship and the like of the support member not shown at an opposite side from the support member 61. An angle at which the center line C1 of the fixing belt 60A crosses the center line C2 of the pressure roller 70 is defined as crossing angle θ.

Next, the flow of generation of deviating force during operation of the pressure roller 70 will be described. During operation of the pressure roller 70, the pressure roller 70 applies turning force F2 to the fixing belt 60. The turning force F2 is orthogonal to the center line C2 of the pressure roller 70. In contrast, the fixing belt 60A is in pressure contact in a state where the center line C1 is crossed with the center line C2 of the pressure roller 70 with a crossing angle θ, so that the turning force F2 is divided into two components, which are a cylindrical direction force F3 and an axial direction force F4 of the fixing belt 60. The cylindrical direction force F3 of the fixing belt 60A becomes a driven rotation movement of the fixing belt 60A. The axial direction force F4 of the fixing belt 60A moves in the direction of the center line C1 of the fixing belt 60A until the fixing belt 60A abuts against the regulating surface 63. In a state where the fixing belt 60A abuts against the regulating surface 63, the speed of the fixing belt 60A in the longitudinal direction Z becomes 0, so that the respective surfaces of the pressure roller 70 and the fixing belt 60A at the fixing nip portion N deform. As a result, normal force (deviating force) occurs at a point of contact between the end portion of the fixing belt 60A and the regulating surface 63 in order to absorb deformation of the fixing nip portion N.

Principle of Reducing Deviating Force by Support Member

Next, a principle of reducing deviating force by the support member 61 will be described in detail. The fixing belt 60A in which deviating force has been generated at the end portion receives normal force from the regulating surface 63. According to component of force of normal force received from the regulating surface 63, the fixing belt 60A receives force toward an upstream side in the sheet conveyance direction X. The position of the fixing belt 60A having received this force is corrected to follow the center line C2 of the pressure roller 70 and rotates to the position of the fixing belt 60B. As a result, the normal force, i.e., deviating force, that the end portion of the fixing belt 60 receives at the point of contact with the regulating surface 63 is reduced. However, the fixing belt 60 cannot rotate around the pressure direction Y as center axis unless there are sufficient gaps between the fixing belt 60 and the retaining portion 64 and between the fixing belt 60 and the regulating surface 63, so that the effect of reducing deviating force does not occur. Therefore, in the present embodiment, sufficient gaps are formed between the fixing belt 60 and the retaining portion 64 and between the fixing belt 60 and the regulating surface 63.

Figure 5A:
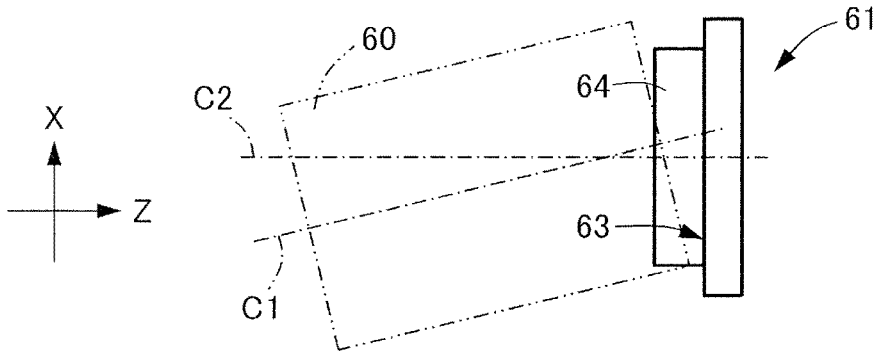
FIG. 5A is a plan view of the support member and the fixing belt of the fixing unit before abutment.
Figure 5B:
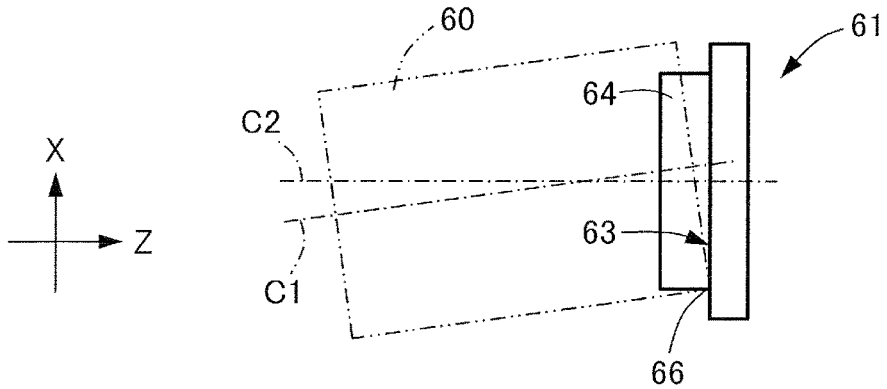
FIG. 5B is a plan view of the support member and the fixing belt of the fixing unit in an abutted state.

The flow of generation of deviating force at the end portion of the fixing belt 60 described above will be described with reference to FIGS. 5A through 5C. As illustrated in FIG. 5A, before the fixing belt 60 abuts against the regulating surface 63, the fixing belt 60 rotates and moves in the longitudinal direction Z. As illustrated in FIG. 5B, if the fixing belt 60 abuts against the upstream side of the regulating surface 63 in the sheet conveyance direction X, the fixing belt 60 turns around an axis of the pressure direction Y passing an abutment point 66 with respect to the regulating surface 63, and the direction of the fixing belt 60 is gradually corrected. The fixing belt 60 abuts locally against the regulating surface 63 at the abutment point 66, turns to a direction where the center line C1 of the fixing belt 60 and the center line C2 of the pressure roller 70 become parallel, and the direction of the fixing belt 60 is gradually corrected. Thereafter, as illustrated in FIG. 5C, the position of the fixing belt 60 is changed to follow the center line C2 of the pressure roller 70 and the direction thereof is corrected, by which deviating force is reduced.

Comparative Example

Figure 8A:
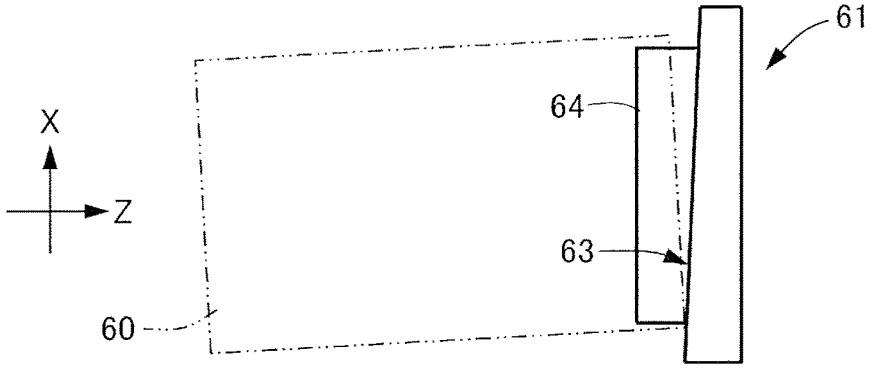
FIG. 8A is a plan view of a support member and a fixing belt of a fixing unit according to a comparative example 1.
Figure 8B:
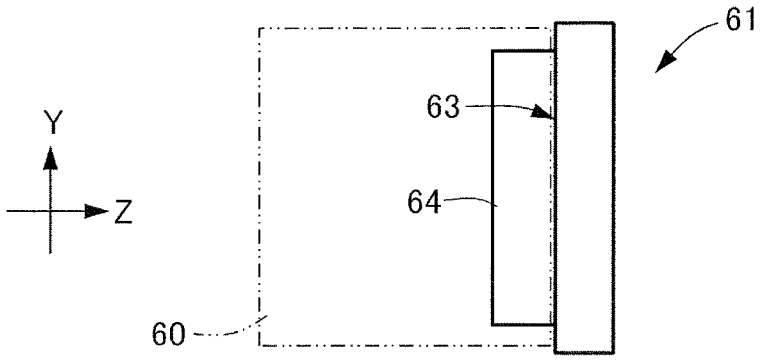
FIG. 8B is a side view of the support member and the fixing belt of the fixing unit according to the comparative example 1.
Figure 8C:
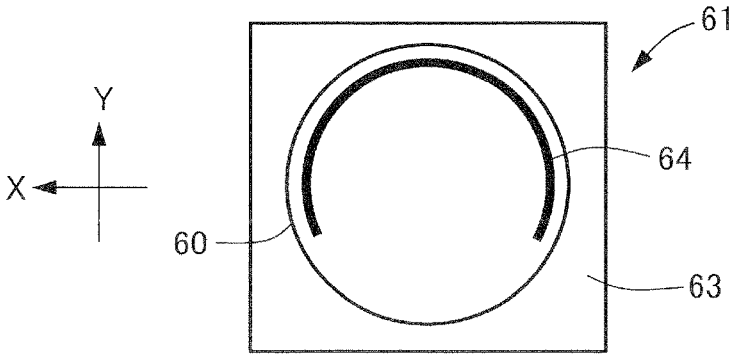
FIG. 8C is a front view of the support member and the fixing belt of the fixing unit according to the comparative example 1.

Now, a comparative example of the regulating surface 63 of the fixing unit 46 will be considered. At first, a regulating surface 63 of comparative example 1 will be illustrated in FIGS. 8A through 8C. As illustrated in FIG. 8A, the regulating surface 63 has an inclined shape in a sheet conveyance direction X when viewed in the pressure direction Y, and the fixing belt 60 is caused to abut against the regulating surface 63 at an upstream side in the sheet conveyance direction X. Further, as illustrated in FIG. 8B, the regulating surface 63 is not inclined in the pressure direction Y when viewed in the sheet conveyance direction X.

Figure 5C:
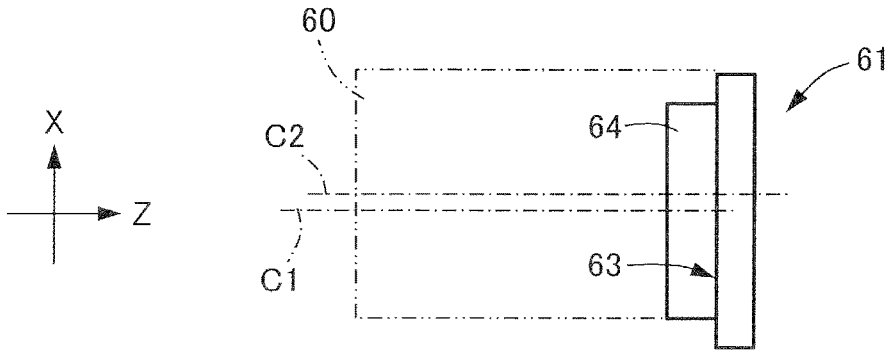
FIG. 5C is a plan view of the support member and the fixing belt of the fixing unit in a state where a certain time has elapsed after abutment.
Figure 10:
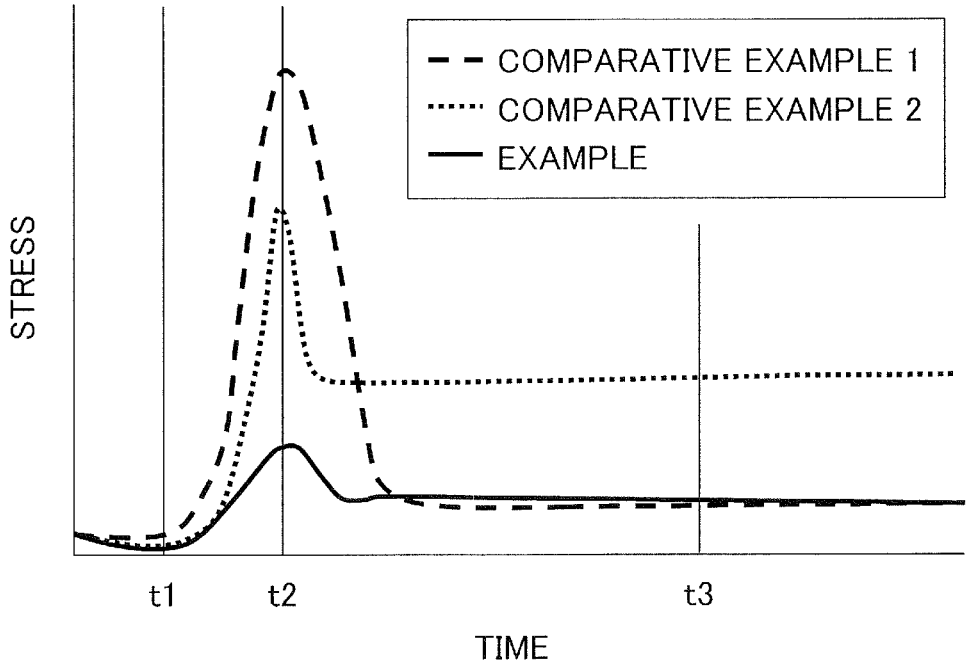
FIG. 10 is a graph illustrating a time variation of stress that occurs at an end portion of the fixing belt.

Regarding such regulating surface 63 of the comparative example 1, time variation of stress of a case where the fixing belt 60 is caused to abut against the regulating surface 63 was measured according to time series illustrated in FIGS. 5A through 5C described earlier. The result is illustrated in FIG. 10. In FIG. 10, time t1 refers to a time before the fixing belt 60 abuts against the regulating surface 63 (refer to FIG. 5A), and time t2 refers to a time when the fixing belt 60 abuts against the regulating surface 63 (refer to FIG. 5B). Further, time t3 refers to a time when the fixing belt 60 has been turned to a position where the center line C1 of the fixing belt 60 is substantially in parallel with the center line C2 of the pressure roller 70 (refer to FIG. 5C). As illustrated in FIG. 10, deviating force is reduced at time t3, but since contact area becomes small at time t2 during abutment, excessive stress is generated at the end portion of the fixing belt 60, and the end portion of the fixing belt 60 may be damaged due to fatigue caused by bending.

Figure 9A:
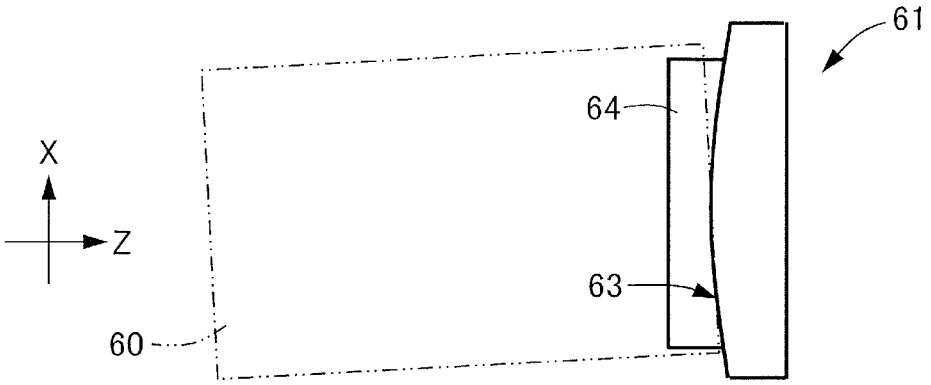
FIG. 9A is a plan view of a support member and a fixing belt of a fixing unit according to a comparative example 2.
Figure 9B:
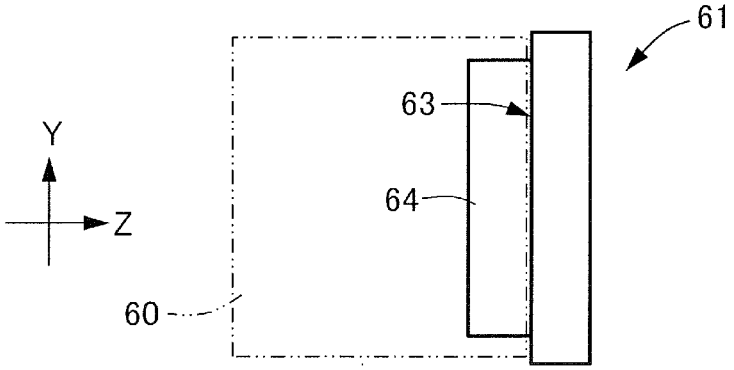
FIG. 9B is a side view of the support member and the fixing belt of the fixing unit according to the comparative example 2.
Figure 9C:
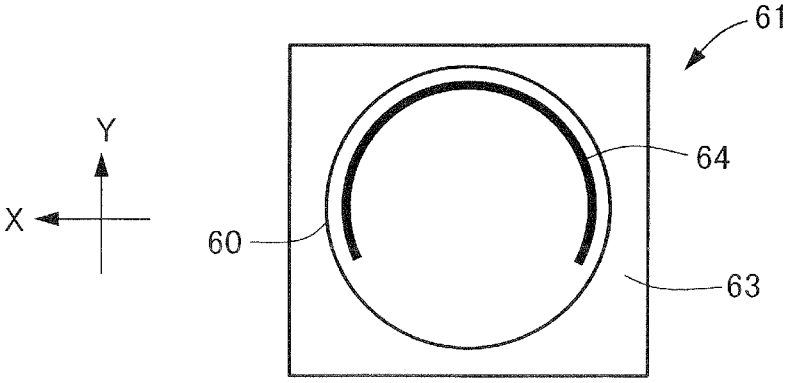
FIG. 9C is a front view of the support member and the fixing belt of the fixing unit according to the comparative example 2.

Next, the regulating surface 63 of comparative example 2 will be illustrated in FIGS. 9A through 9C. As illustrated in FIG. 9A, the regulating surface 63 has a gentle curved shape in the sheet conveyance direction X when viewed in the pressure direction Y. Further, as illustrated in FIG. 9B, the regulating surface 63 is not inclined in the pressure direction Y when viewed in the sheet conveyance direction X. Regarding such regulating surface 63 of the comparative example 2, the time variation of stress in a case where the fixing belt 60 is abutted against the regulating surface 63 was measured according to time series illustrated in FIGS. 5A through 5C described earlier. The result is illustrated in FIG. 10. As illustrated in FIG. 9A, the contact area at time t2 is greater than the comparative example 1, so that as illustrated in FIG. 10, stress at time t2 is reduced, but since the effect of reduction of deviating force cannot be exerted sufficiently, stress is not sufficiently reduced at time t3. Therefore, abrasion at the end portion of the fixing belt 60 is advanced, and the end portion of the fixing belt 60 may be damaged.

As described, according to comparative examples 1 and 2, stress at the end portion of the fixing belt 60 cannot be reduced sufficiently at times t2 or t3, and there was a drawback that the end portion of the fixing belt 60 may be damaged.

Regulating Surface of Present Embodiment

Figure 6:
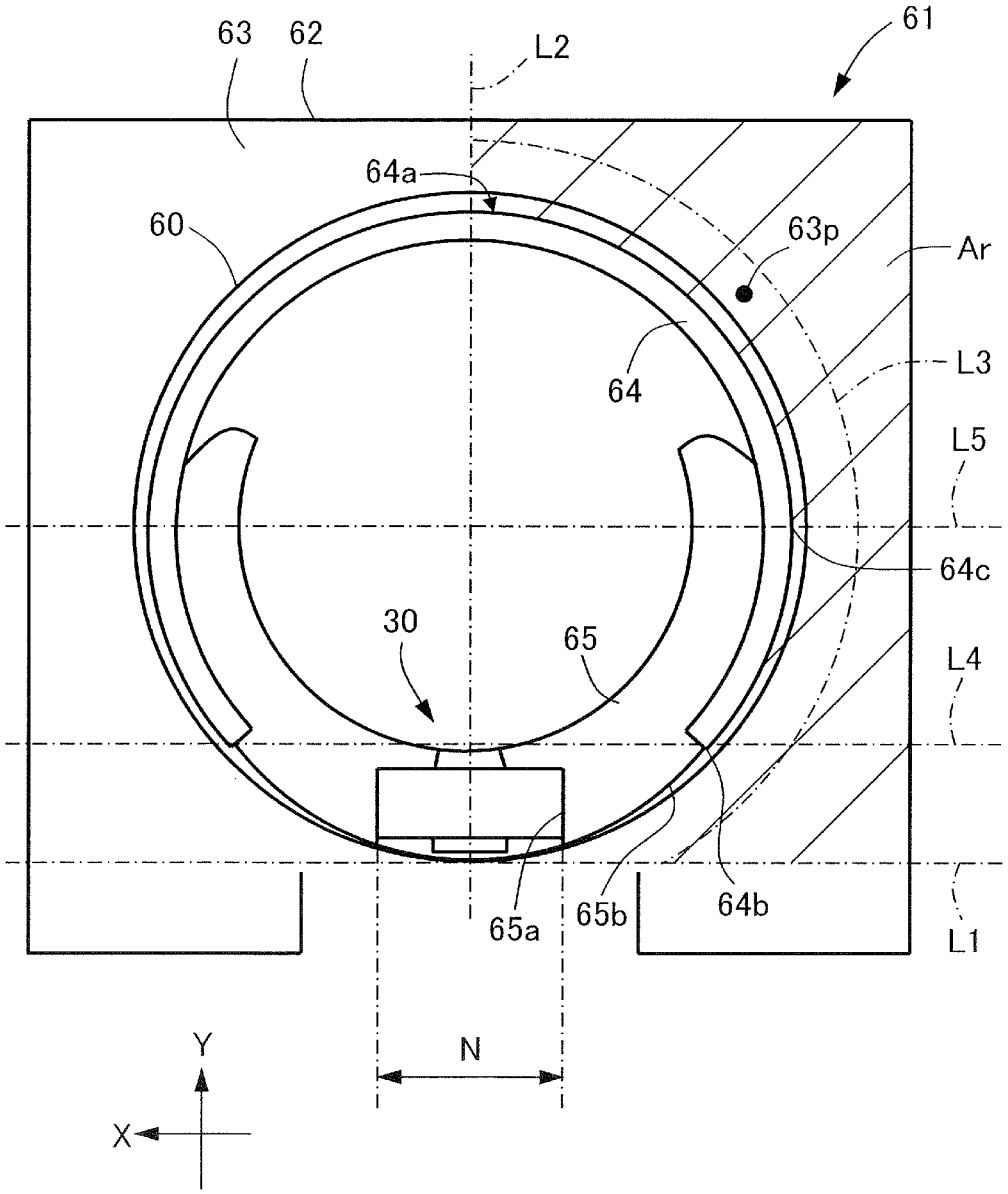
FIG. 6 is a front view of the support member and the fixing belt of the fixing unit according to the present embodiment.
Figure 7A:
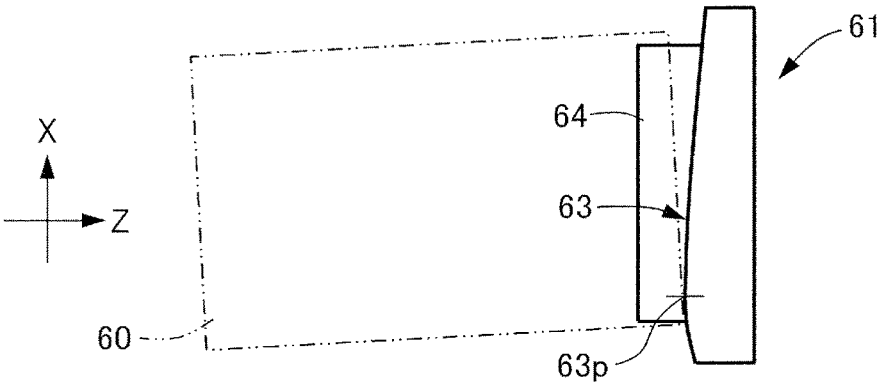
FIG. 7A is a plan view of the support member and the fixing belt of the fixing unit according to the present embodiment.
Figure 7B:
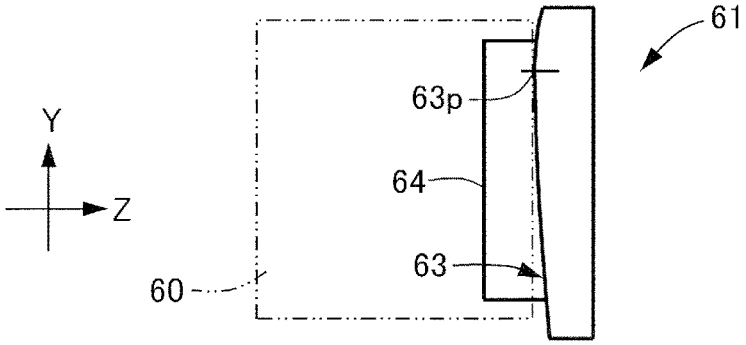
FIG. 7B is a side view of the support member and the fixing belt of the fixing unit according to the present embodiment.
Figure 7C:
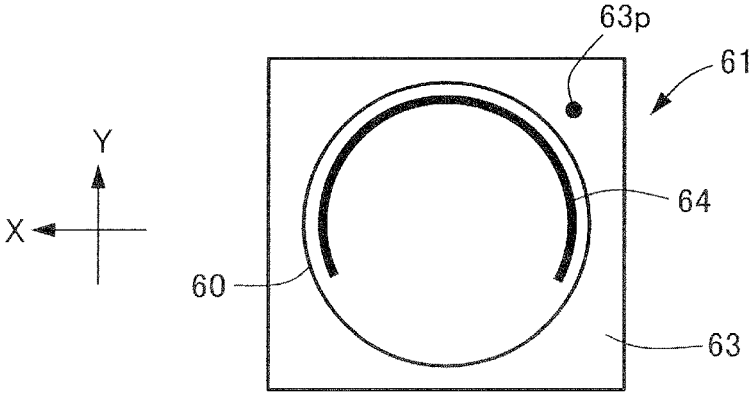
FIG. 7C is a front view of the support member and the fixing belt of the fixing unit according to the present embodiment.

Therefore, according to the present embodiment, as illustrated in FIGS. 7A through 7C, the regulating surface 63 is designed to have a curved surface shape with a radius of curvature of 10 mm or greater and 500 mm or smaller protruding to the side of the fixing belt 60. Further, as illustrated in FIG. 6, an apex portion 63*p* of the curved surface shape of the regulating surface 63 is positioned on the side of the fixing belt 60 from a tangent L1 of the fixing belt 60 passing the fixing nip portion N when viewed in the longitudinal direction Z and in an area Ar (illustrated by the hatching in FIG. 6) on the outer circumferential side of the retaining portion 64. Further, the apex portion 63*p* of the curved surface shape of the regulating surface 63 is positioned in the area Ar (illustrated by the hatching in FIG. 6) upstream in the sheet conveyance direction X of a straight line L2 that passes a center of the fixing nip portion N with respect to the sheet conveyance direction X and is orthogonal to the tangent L1. Thereby, the following effects can be exerted.

At first, since the regulating surface 63 has the curved surface shape with the radius of curvature of 10 mm or greater and 500 mm or smaller protruding toward the fixing belt 60, the contact area of the end portion of the fixing belt 60 is increased compared to cases where the whole surface is an inclined surface or where a portion of the surface is in a straight line. Since the stress that occurs by the end portion of the fixing belt 60 abutting against the regulating surface 63 is determined by the relationship between deviating force and contact area, the stress being generated can be reduced by increasing the contact area. Further, the abutment position of the fixing belt 60 against the regulating surface 63 may be varied by the state of rotation of the fixing belt 60 or the looseness of the support member 61, but since the whole regulating surface 63 is curved, the contact area can be expanded in any state of contact. Therefore, according to the fixing unit 46 of the present embodiment, increase of stress that occurs at the end portion of the fixing belt 60 is suppressed and reduction of thickness of the fixing belt 60 is enabled.

If the radius of curvature of the regulating surface 63 is smaller than 10 mm, the apex portion 63*p* would be too sharp, and it becomes difficult to expand the contact area of the end portion of the fixing belt 60 abutting against the regulating surface 63, so that it is not preferable. Further, if the radius of curvature of the regulating surface 63 exceeds 500 mm, the surface would become almost flat, and it becomes difficult to expand the contact area of the end portion of the fixing belt 60 abutting against the regulating surface 63, so that it is not preferable. The preferable range of the radius of curvature of the regulating surface 63 is changed arbitrarily, for example, in accordance with the material, characteristics and thickness of the fixing belt 60. For example, if the fixing belt 60 is a polyimide base layer, the range should preferably be 20 mm or greater and 500 mm or smaller, and most preferably, 250 mm (refer to Table 1). Further, if the fixing belt 60 is a SUS base layer, the range should preferably be 10 mm or greater and 300 mm or smaller, and most preferably, 150 mm (refer to Table 2).

Further, by positioning the apex portion 63*p* of the curved surface shape of the regulating surface 63 to be on the side of the fixing belt 60 from the tangent L1 when viewed in the longitudinal direction Z and in the area Ar on the outer circumferential side of the retaining portion 64, the apex portion 63*p* can be arranged within the overall area in which the fixing belt 60 can contact. Further, in a state where the end portion of the fixing belt 60 abuts against the regulating surface 63, normally, it abuts against the upstream side of the straight line L2 in the sheet conveyance direction X (refer to FIG. 4). Therefore, according to the present embodiment, by positioning the apex portion 63*p* in the area Ar upstream of the straight line L2 in the sheet conveyance direction X, the apex portion 63*p* can be arranged in the area (refer to FIG. 4) where the end portion of the fixing belt 60 is most likely to abut against first. If the apex portion is positioned downstream of the straight line L2 in the sheet conveyance direction X, the fixing belt 60 is turned until the fixing belt 60 abutting against the upstream side of the straight line L2 in the sheet conveyance direction X becomes parallel with the pressure roller 70. In this state, before the fixing belt 60 becomes parallel with the pressure roller 70, the end portion of the fixing belt 60 will abut against the area downstream of the straight line L2 of the regulating surface 63, which is not preferable since smoothness of turning of the fixing belt 60 is inhibited compared to the present embodiment. In contrast, according to the present embodiment, the end portion of the fixing belt 60 abuts against the proximity of the apex portion 63*p* when the fixing belt 60 abuts against the regulating surface 63, so that the fixing belt 60 can be turned smoothly until it becomes parallel with the pressure roller 70.

According to the present embodiment, as illustrated in FIG. 6, the apex portion 63*p* is positioned in an area within 5 mm toward the outer circumferential side from an outer circumferential surface 64*a* of the retaining portion 64 and the outer circumferential surface 65*b* of the heater holder 65 (between curved line L3 and the outer circumferential surfaces 64*a* and 65*b*) when viewed in the longitudinal direction Z. According to this configuration, the apex portion 63*p* can be positioned in an area where the end portion of the fixing belt 60 is most likely to abut against. The area is set to be within 5 mm toward the outer circumferential side from the outer circumferential surfaces 64*a* and 65*b*, since the movable range of rotation track of the fixing belt 60 is approximately 5 mm at maximum That is, the apex portion 63*p* is positioned within the variable range of rotation track of the fixing belt 60 when viewed in the longitudinal direction Z. Therefore, the apex portion 63*p* is either positioned within or outside the rotation track of the fixing belt 60.

Further according to the present embodiment, the apex portion 63*p* is positioned on an opposite side from the fixing nip portion N with respect to a straight line L4 that is parallel to the tangent L1 and that passes an end portion 64*b* on the side of the fixing nip portion N of the retaining portion 64 when viewed in the longitudinal direction Z. Thereby, the apex portion 63*p* can be arranged at an area where the end portion of the fixing belt 60 is likely to abut against first.

Further according to the present embodiment, the apex portion 63*p* is positioned on an opposite side from the fixing nip portion N with respect to a straight line L5 that is parallel to the tangent L1 and that passes an upstream end 64*c* of the retaining portion 64 with respect to the sheet conveyance direction X when viewed in the longitudinal direction Z. Thereby, the apex portion 63*p* can be arranged at an area where the end portion of the fixing belt 60 is likely to abut against first.

According to the present embodiment, the apex portion 63*p* is positioned, for example, at a distance of 0.5 mm toward the outer circumference side from the outer circumferential surface 64*a* approximately at a center portion of the retaining portion 64 at an area upstream of the straight line L2 in the sheet conveyance direction X and downstream of the straight line L5 in the pressure direction Y.

Further according to the present embodiment, the regulating surface 63 is formed on a whole area of the outer circumferential side of the retaining portion 64. Therefore, the area of contact of the end portion of the fixing belt 60 on the whole area of the outer circumferential side of the retaining portion 64 can be expanded. However, the regulating surface 63 is not necessarily formed on the whole area on the outer circumferential side of the retaining portion 64, and it can be formed on a portion of the outer circumferential side of the retaining portion 64. In that case, for example, it can be formed on the upstream side of the straight line L2 in the sheet conveyance direction X.

As described above, according to the fixing unit 46 of the present embodiment, the regulating surface 63 has the curved surface shape with the radius of curvature of 10 mm or greater and 500 mm or smaller and protruding toward the fixing belt 60, so that the area in which the end portion of the fixing belt 60 contacts the regulating surface 63 can be expanded. By widening the contact area, the stress being generated can be reduced, so that it becomes possible to suppress increase of stress that is generated at the end portion of the fixing belt 60 and reduce the thickness of the fixing belt 60.

According further to the fixing unit 46 of the present embodiment, since the apex portion 63*p* is positioned in the area Ar upstream of the straight line L2 in the sheet conveyance direction X, the apex portion 63*p* can be arranged in an area where the end portion of the fixing belt 60 is most likely to abut against first. Thereby, the end portion of the fixing belt 60 will abut against the vicinity of the apex portion 63*p* when abutting against the regulating surface 63, so that it becomes possible to enable the fixing belt 60 to turn smoothly until it becomes parallel with the pressure roller 70.

According to the fixing unit 46 of the present embodiment described above, a case has been illustrated where the regulating surface 63 having the curved surface shape and having the apex portion 63*p* formed at the predetermined position is formed on both of the support members 61 arranged at both end portions of the fixing belt 60, but the present invention is not restricted thereto. Such a regulating surface 63 may also be formed on only one of the pair of support members 61 arranged at both end portions of the fixing belt 60.

Example

Time variation of stress when the fixing belt 60 is abutted against the regulating surface 63 of the support member 61 of the fixing belt 46 according to the present embodiment was measured according to time series illustrated in FIGS. 5A through 5C. The result is illustrated in FIG. 10. As illustrated in FIG. 10, generation of stress at time t2 and time t3 has been reduced to a minimum according to the present embodiment. Therefore, it is possible to prevent damage from being generated at the end portion of the fixing belt 60.

Next, the relationship between radius of curvature of the regulating surface 63 and lifetime of the fixing belt 60 was measured according to the fixing unit 46 of the present embodiment. At first, a measurement method of shape of the regulating surface 63 and a measurement method of lifetime of the fixing belt 60 will be described.

Method for Measuring Shape of Regulating Surface

Convex shape measurement of the regulating surface 63 of the fixing belt 60 was performed by three-dimensional shape measurement using One-Shot 3D Measurement System VR-3000 (product of Keyence Corporation). Image measurement was performed using a low magnification mode magnified by 12 times/25 times. As analytical software, an accessory of One-Shot 3D Measurement System VR-3000 (product of Keyence Corporation) was used. The closest point from a reference surface that is perpendicular to the center line C2 of the pressure roller 70 and set arbitrarily on the fixing belt 60 side from the regulating surface 63 is defined as the apex portion 63*p* of the regulating surface 63. During measurement, after the apex portion 63*p* has been specified by 12 times magnification, image was acquired again using the 25 times magnification with the apex portion 63*p* set at the center. The data acquired by 25 times magnification was analyzed by profile measurement of analyzing mode. During analysis, the apex portion 63*p* was specified by designating range. A cross-section perpendicular to the pressure direction Y and the sheet conveyance direction X is cut so as to pass the specified apex portion 63*p*. The radius of curvature is computed by designating three points in a circular fitting mode regarding the cutout cross-section. For calculation of radius of curvature of the apex portion 63*p*, a minimum radius of curvature in a cross section perpendicular to the pressure direction Y and the minimum radius of curvature perpendicular to the sheet conveyance direction X in the apex portion 63*p* are measured. If the minimum radius of curvature differs between the cross-section of the pressure direction Y and the cross-section of the sheet conveyance direction X, the smaller radius of curvature was adopted as the measurement value. Further, if radii that differ in the convex and concave directions are displayed after performing measurement for a few times during fitting, the surface was determined as a flat surface, and the radius of curvature was defined as infinite Method for Determining Lifetime of Fixing Belt At first, lifetime was evaluated in a printer (Product name: image RUNNER ADVANCE C355F of Canon Inc.) as measurement for determining lifetime in a case where the fixing belt 60 is formed of a polyimide base material. The peripheral speed of the pressure roller 70 mounted on the fixing unit 46 was set to 200 mm/sec, and the temperature of the heater portion 30 was set to 190 degrees. The method for determining lifetime was performed using the following method. After performing continuous printing of a printing pattern to 100 sheets, power was turned off temporarily, and thereafter, continuous printing of 100 sheets was performed again, and this procedure was repeatedly performed. The number of sheets to which printing has been performed until a crack occurs to the fixing belt 60 was defined as the lifetime. The occurrence of damage at the end portion of the fixing belt 60 was determined by visual confirmation. Target is defined as achieved if the number of sheets has exceeded 200000 sheets as lifetime. The temperature and humidity condition during measurement was set to 23° C. and 30%. In the present measurement, the fixing belt 60 having a base layer formed of polyimide with a diameter of 18 mm and a thickness of 60 μm, and the pressure roller 70 including the elastic layer 72 having a silicon rubber with a thickness of 3.5 mm and the release layer 73 formed of a tube having a thickness of 50 μm formed of PFA were used. The angle of the fixing belt 60 was adjusted so that the crossing angle θ (refer to FIG. 4) becomes 0.15 degrees. The sheet being used was an A4-sized sheet of CS-680 (product of Canon Inc.).

Based on the above-described method, determination was performed based on examples with the radii of curvature varied, a comparative example 1 (FIGS. 8A through 8C), and a comparative example 2 (FIGS. 9A through 9C). In the comparative example 1, an inclined surface shape of a cross-section of pressure direction Y was set to one degree, and in the comparative example 2, the radius of curvature of a cross-sectional surface of pressure direction Y was set to 300 mm. The result is shown in Table 1.

TABLE 1

| ITEM | RADIUS OF CURVATURE (mm) | LIFE EVALUATION (NUMBER OF SHEETS) | DETERMINATION | STATE OF DAMAGE |
|---|---|---|---|---|
| EXAMPLE | 600 | 100,000 | BAD | ABRASION OF END PORTION |
| | 500 | 200,000 | GOOD | — |
| | 400 | 300,000 | GOOD | — |
| | 300 | 420,000 | GOOD | — |
| | 200 | 400,000 | GOOD | — |
| | 100 | 250,000 | GOOD | — |
| | 50 | 220,000 | GOOD | — |
| | 20 | 200,000 | GOOD | — |
| | 10 | 100,000 | BAD | CRACK OF END PORTION |
| | 5 | 20,000 | BAD | CRACK OF END PORTION |
| COMPARATIVE EXAMPLE 1 | — | 120,000 | BAD | CRACK OF END PORTION |
| COMPARATIVE EXAMPLE 2 | — | 150,000 | BAD | ABRASION OF END PORTION |

As illustrated in Table 1, in the example, it has been confirmed that the target has been achieved in the range where the radius of curvature is 20 mm or greater and 500 mm or smaller. In a case where the radius of curvature was smaller than 20 mm, increase of stress during correction of deviating force caused damage that lead to cracks being generated at the end portion of the fixing belt 60, and lifetime was not achieved. If the radius of curvature exceeded 500 mm, end portion abrasion had occurred due to not sufficiently reduced deviating force, and lifetime was not achieved. In the comparative example 1, damage leading to cracks at the end portion of the fixing belt 60 occurred, and lifetime was not achieved. In comparative example 2, as illustrated in FIG. 10, the deviating force could not be sufficiently reduced, so that end portion abrasion occurred and lifetime was not achieved. Therefore, the effect of the present example regarding comparative examples 1 and 2 was confirmed.

Next, lifetime was evaluated in a printer (Product name: image RUNNER ADVANCE C3530F of Canon Inc.) as measurement for determining lifetime in a case where the fixing belt 60 is formed of a SUS base material. The peripheral speed of the pressure roller 70 mounted on the fixing unit 46 was set to 120 mm/sec, and the temperature of the heater portion 30 was set to 190 degrees. In the present measurement, the fixing belt 60 having a base layer formed of SUS with a diameter of 12 mm and a thickness of 30 μm, and the pressure roller 70 including the elastic layer 72 having a silicon rubber with a thickness of 2.5 mm and the release layer 73 formed of a tube having a thickness of 50 μm formed of PFA were used. The other conditions were set similar to the measurement for determining lifetime described above in the case where the polyimide base material was used. Further, based on the above-described method, determination was performed based on examples with the radii of curvature varied, a comparative example 1 (FIGS. 8A through 8C), and a comparative example 2 (FIGS. 9A through 9C). The result is shown in Table 2.

TABLE 2

| ITEM | RADIUS OF CURVATURE (mm) | LIFE EVALUATION (NUMBER OF SHEETS) | DETERMINATION | STATE OF DAMAGE |
|---|---|---|---|---|
| EXAMPLE | 500 | 100,000 | BAD | ABRASION OF END PORTION |
| | 400 | 150,000 | BAD | ABRASION OF END PORTION |
| | 300 | 320,000 | GOOD | — |
| | 200 | 450,000 | GOOD | — |
| | 100 | 400,000 | GOOD | — |
| | 50 | 300,000 | GOOD | — |
| | 20 | 220,000 | GOOD | — |
| | 10 | 200,000 | GOOD | — |
| | 5 | 100,000 | BAD | CRACK OF END PORTION |
| | 2.5 | 20,000 | BAD | CRACK OF END PORTION |
| COMPARATIVE EXAMPLE 1 | — | 120,000 | BAD | CRACK OF END PORTION |
| COMPARATIVE EXAMPLE 2 | — | 150,000 | BAD | ABRASION OF END PORTION |

As shown in Table 2, the evaluation result of the fixing belt 60 using the SUS base layer was similar to the evaluation result of the fixing belt 60 using the polyimide base layer shown in Table 1. In the case of the SUS base layer, the fixing belt 60 had a stronger property against low radius of curvature compared to the polyimide base layer but was vulnerable to damage in high radius of curvature. Since the SUS base layer has higher rigidity compared to the polyimide base layer, deformation or crack at the end portion is less likely to occur, which is considered to be the main cause of damage by abrasion at the end portion. Therefore, the effect of the present embodiment with respect to comparative examples 1 and 2 has been confirmed. As described above, based on the results shown in Tables 1 and 2, it has been confirmed that the stress at the end portion of the fixing belt 60 could be reduced in a range where the radius of curvature of the regulating surface 63 is 10 mm or greater and 500 mm or smaller.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-119322, filed Jun. 22, 2018 which is hereby incorporated by reference herein in its entirety.

What is claimed is:

1. An image heating apparatus configured to heat an image formed on a sheet, the image heating apparatus comprising:

a rotatable belt;

a rotary member configured to be in pressure contact with the belt, form a nip portion with the belt, nip a sheet at the nip portion to convey the sheet, and heat an image on the sheet;

a support member configured to support an end portion of the belt in a sheet width direction orthogonal to a sheet conveyance direction at the nip portion;

a retaining portion provided on the support member and configured to guide the belt while retaining the end portion of the belt from an inner circumference side in a rotatable manner; and a regulating portion provided on the support member against which the end portion of the belt is configured to abut and configured to regulate movement of the belt in the sheet width direction, wherein the regulating portion comprises a curved surface shape having a radius of curvature of 10 mm or greater and 500 mm or smaller and protruding toward the belt, wherein as viewed in the sheet width direction, an apex portion of the curved surface shape is positioned in an area outside of the retaining portion, on a side of the belt from a tangent of the belt at the nip portion, and upstream of a straight line that is orthogonal to the tangent in the sheet conveyance direction, and wherein as viewed in the sheet wide direction, a distance between the apex portion and an outer circumferential surface of the retaining portion is less than or equal to 5 mm.

2. The image heating apparatus according to claim 1, wherein the apex portion is positioned within a variable range in a radial direction of rotation track of the rotating belt when viewed in the sheet width direction.

3. The image heating apparatus according to claim 1, wherein the apex portion is positioned on an opposite side from the nip portion with respect to a straight line that passes an end portion on a side of the nip portion of the retaining portion and that is parallel to the tangent when viewed in the sheet width direction.

4. The image heating apparatus according to claim 1, wherein the apex portion is positioned on an opposite side from the nip portion with respect to a straight line that passes an upstream end of the retaining portion with respect to the sheet conveyance direction and that is parallel to the tangent when viewed in the sheet width direction.

5. The image heating apparatus according to claim 1, wherein the curved surface is formed on a whole area of an outer circumferential side of the retaining portion, wherein the regulating portion is formed along the whole retaining portion.

6. The image heating apparatus according to claim 1, wherein the apex portion is positioned on an opposite side from the nip portion with respect to a straight line that passes a rotational center of the belt with respect to the sheet conveyance direction and that is parallel to the tangent when viewed in the sheet width direction.

7. The image heating apparatus according to claim 1, further comprising:

a planar heater in contact with the belt and configured to heat the belt, wherein the rotary member is configured to be pressed to the heater via the belt.

* * * * *